US005913540A

United States Patent [19]

Ong

[11] Patent Number: 5,913,540

[45] Date of Patent: Jun. 22, 1999

[54] ONE-PIECE, DUAL POCKET DOCUMENT HOLDER

[76] Inventor: Bon S. Ong, P.O. Box 4247, Torrance, Calif. 90510

[21] Appl. No.: 08/855,840

[22] Filed: May 12, 1997

[51] Int. Cl.[6] ..... B42D 3/00

[52] U.S. Cl. ..... 281/31; 281/37; 402/79

[58] Field of Search ..... 281/29, 31, 38, 281/51; 402/79

[56] References Cited

U.S. PATENT DOCUMENTS

| | | | |
|---|---|---|---|
| 4,520,958 | 6/1985 | Jones et al. | 281/31 X |
| 4,852,740 | 8/1989 | Sellar et al. | 281/31 X |
| 5,417,509 | 5/1995 | Schwartz | 281/31 X |
| 5,586,829 | 12/1996 | Schwartz | 281/31 X |
| 5,660,514 | 8/1997 | Wilson | 281/31 X |

*Primary Examiner*—Willmon Fridie, Jr.
*Attorney, Agent, or Firm*—Charles H. Thomas

[57] ABSTRACT

A document holder is formed from a single sheet of flat stock folded a plurality times by mutually parallel, transverse folds that together form front and rear pockets. One of the transverse folds delineates the bottom of the front pocket, while another of the transverse folds delineates the bottom of the rear pocket. The bottoms of the front and rear pockets are spaced from each other in a direction perpendicular to the transverse folds a distance of at least about one-half of one inch. Both pockets have opposing sides. At least one of the sides of each of the pockets is closed. By longitudinally spacing the pocket bottoms from each other, stress on the structure of the pockets is greatly reduced when thick documents are inserted into the pockets. The reduction of stress in the structure of the flat sheet of stock forming the document holder markedly prolongs its useful life.

16 Claims, 13 Drawing Sheets

ONE-PIECE, DUAL POCKET DOCUMENT HOLDER

BACKGROUND OF THE INVENTION

1. Field of the Invention

The present invention relates to a document holder constructed by folding a single, flat sheet of stock to form a plurality of pockets, the bottoms of which are longitudinally spaced from each other at least a predetermined, minimum, longitudinal distance.

2. Description of the Prior Art

In the field of office supply products various types of document holders have been devised, some of which are formed by folding a single, flat sheet of stock, such as heavy paper, card stock, or plastic. Some of these conventional holders are formed in such a manner as to delineate a plurality of pockets located one behind another. Such document holders may be punched along the side for securement in a conventional three-ring binder, or punched at the top for securement is a file by means of pronged fasteners.

One defect in the construction of conventional document holding devices of this type is that the bottoms of at least some of the pockets formed are in substantial longitudinal alignment with each other. That is, the pocket bottoms are longitudinally offset from each other by only the thickness of the stock used to form the document holder.

In a conventional document holder construction of this type the insertion of documents in the plurality of pockets creates a severe strain on the structural integrity of the stock used to form the document holder at the pocket bottoms. This is particularly true when the documents inserted into the pockets are relatively thick. In such a case there are considerable forces tending to tear the pockets apart at the pocket bottoms.

SUMMARY OF THE INVENTION

The present invention provides a system for creating a document holder having a plurality of pockets from a single sheet of folded stock in which the stress on the stock at the bottoms of the pockets is greatly reduced from that which occurs in conventional document holder structures. This is achieved by folding the sheet of stock with a series of transverse folds such that the bottoms of the pockets are longitudinally offset in spaced separation from each other by at least a predetermined minimum distance. The bottoms of the pockets are thereby longitudinally spaced from each other a distance sufficient so that documents inserted in one pocket do not create stress on the folded sheet of stock at the bottom of an adjacent pocket. This construction very significantly increases the useful life of the document holder.

A related object of the invention is to form from economical stock material a document holder from a single sheet of folded stock so as to have a plurality of pockets. Because the structure of the document holder of the invention avoids undue stress at the bottoms of the several pockets, relatively thin and economic stock materials may be utilized in the fabrication of document holders according to the invention.

In the field of office supplies each article of manufacture is typically quite low in cost, but many office supply articles are manufactured and sold in very large quantities. Therefore, even a very small decrease in unit cost is very important to the commercial acceptability of an office supply product.

In one broad aspect the present invention may be considered to be a document holder formed from a single, flat sheet of stock folded a plurality of times by mutually parallel transverse folds that together form at least two pockets. Some of these transverse folds delineate bottoms for the pockets. The pocket bottoms are spaced from each other in a direction perpendicular to the transverse folds. The pockets have opposing sides that terminate at the pocket bottoms. At least one side of each of the pockets is closed.

In one form of the invention, the sheet includes three transverse folds as described. One of the two pockets formed is a rear pocket while the other is a front pocket. The rear pocket is deeper than the front pocket and the bottoms of the pockets are spaced longitudinally from each other a distance of at least about one-half of an inch. This distance is adequate to relieve the stress sufficiently in twenty-four pound paper, card stock, and in polypropylene or polyethylene plastic as thin as 0.01 millimeters in thickness so that the pocket bottoms will withstand extended use even when packets of documents of one-half inch in thickness, or even greater, are placed in the pockets.

In one preferred construction of a document holder according to the invention the transverse folds delineate a back panel and an apron panel for each of the front and rear pockets. The apron panel for the rear pocket serves as the back panel for the front pocket. This panel, which is common to both the front and rear pockets, is formed by first folding the sheet of stock transversely in one direction. The remaining structure of the document holder is then formed by folding the sheet of stock twice in the opposite direction with two longitudinally separated folds.

The document holder of the invention may also be formed with a front pocket closure tab which is created by a cut within the apron panel for the rear pocket. The front pocket closure tab may be created by a generally trapezoidal-shaped incision in the stock directed toward the pocket bottoms. The front pocket closure tab is resiliently deflectable to extend out over and overhang and capture the top of the apron panel of the front pocket.

The document holder of the invention may also be formed into a folder. In this construction the sheet of flat stock is longitudinally bifurcated by a longitudinal fold that extends perpendicular to the transverse folds. With the transverse folds extending across the entire width of the stock, a folder with two sets of at least two pockets is created. One set of pockets resides on each side of the bifurcating longitudinal fold.

In some embodiments of the invention the document holder may be of a rectilinear configuration formed from a single sheet of flat stock having a pair of opposing, mutually parallel, transverse edges and a pair of opposing, mutually parallel, longitudinal edges. The sheet of flat stock is folded with a plurality of transverse folds parallel to the transverse edges to define a plurality of pockets, each having a bottom. The bottoms of the pockets are located at different longitudinal distances from the transverse edges in spaced separation from each other. The pockets both have sides, at least one of which is sealed shut along at least one line of sealing parallel to the longitudinal edges.

The invention may be described with greater clarity and particularity by reference to the accompanying drawings.

DESCRIPTION OF THE EMBODIMENTS

Figure 1:
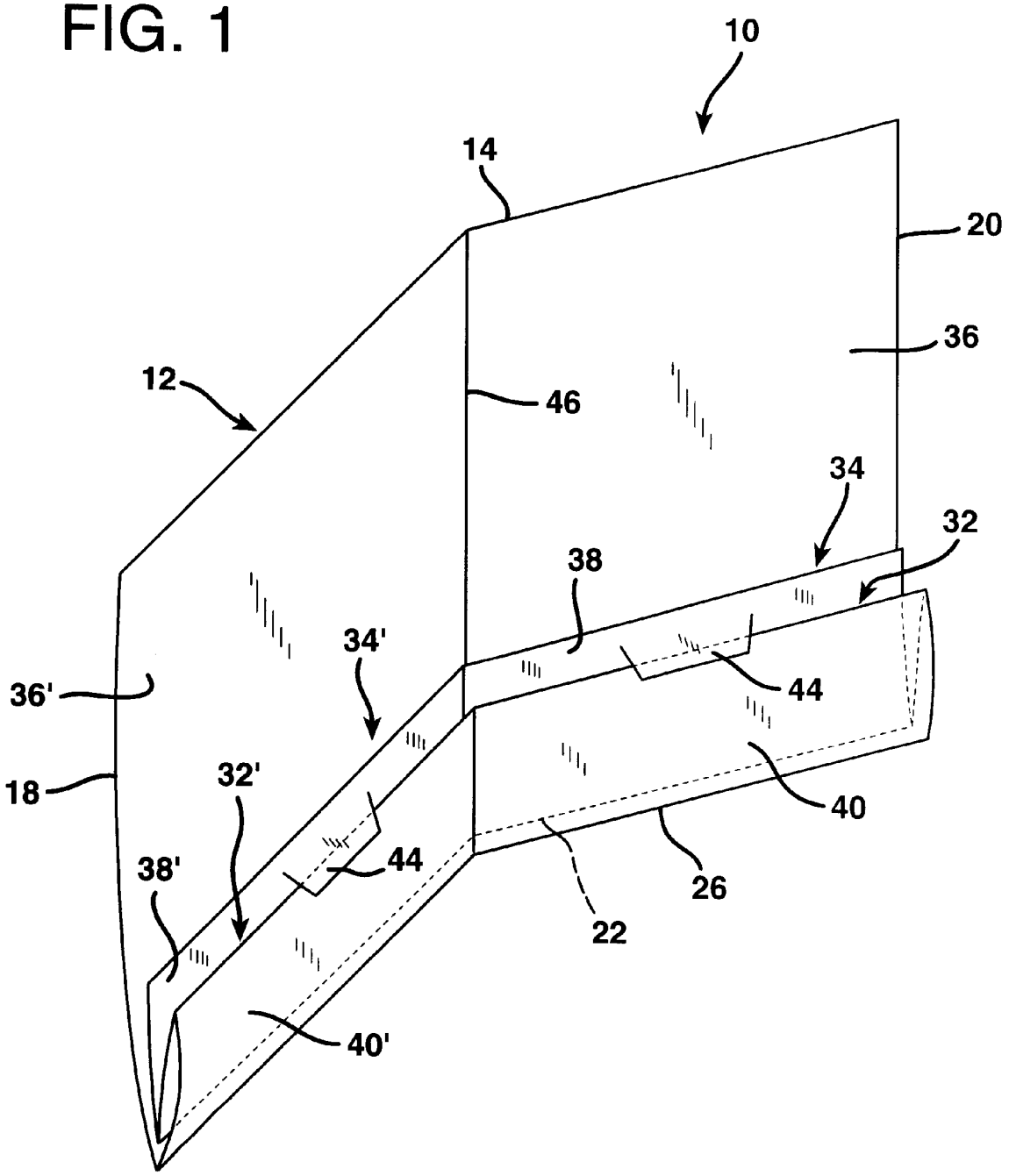
FIG. 1 is a perspective view of one preferred embodiment of a document holder according to the invention shown before the pockets sides thereof are sealed shut.
Figure 2:
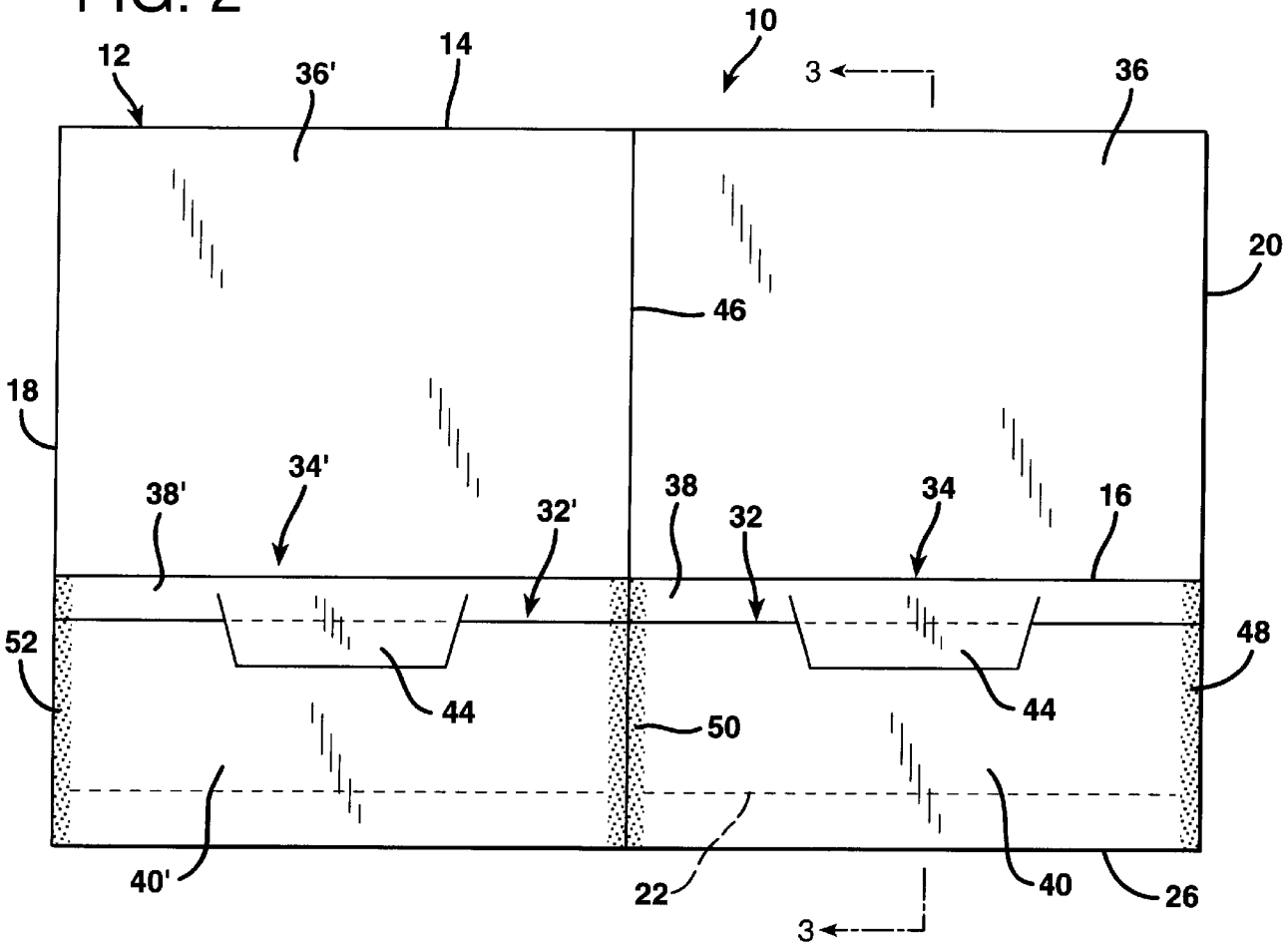
FIG. 2 is a front plan view of the finished document holder of FIG. 1.
Figure 4:
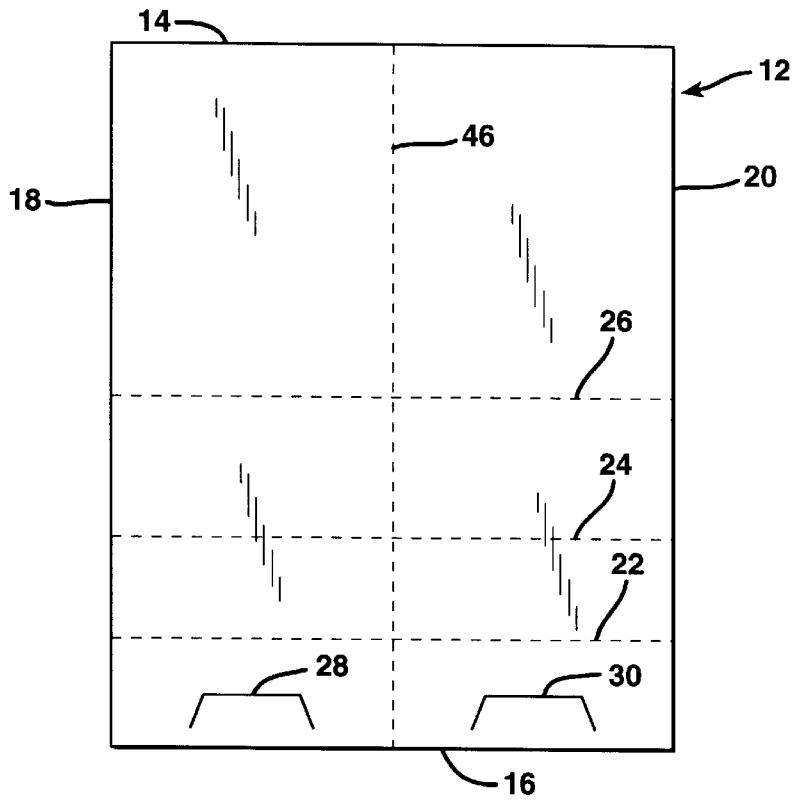
FIG. 4 is a top plan view of the single sheet of stock used to form the document holder of FIGS. 1 and 2.
Figure 5:
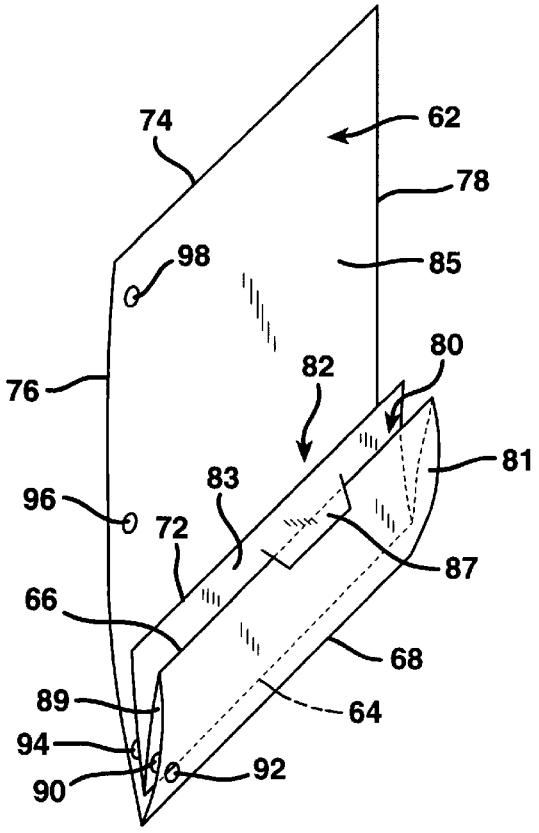
FIG. 5 is a perspective view of an alternative embodiment of a document holder constructed according to the invention shown before the sides of the pockets thereof are sealed.
Figure 7:
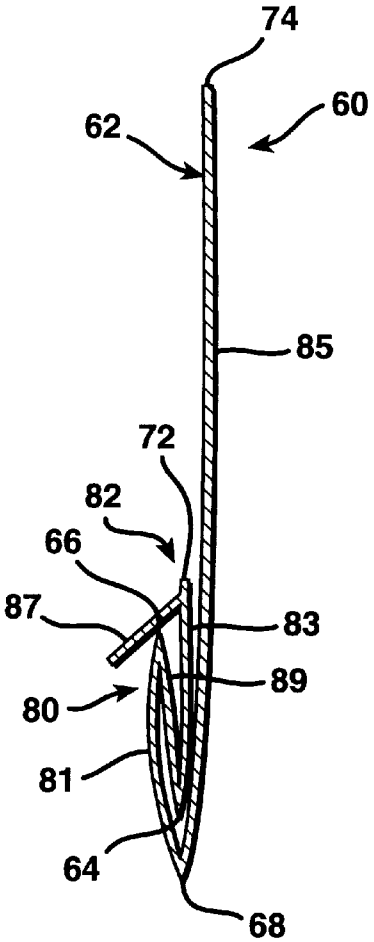
FIG. 7 is a sectional view taken along the lines 7—7 of FIG. 6.

FIGS. 1 and 2 illustrate a document holder 10 formed from a single, rectangular sheet of flat stock 12 depicted in FIG. 4. The sheet 12 may be formed of heavy paper, manila folder stock, card stock, or a sheet of plastic, such a polyethylene or polypropylene. The sheet of flat stock 12 is formed with a pair of opposing, mutually parallel, transverse edges, specifically an upper edge 14 and a lower edge 16. The sheet of flat stock 12 is also formed with a pair of opposing, mutually parallel, longitudinally extending side edges, specifically a side edge 18 and a opposing side edge 20.

As indicated in dotted lines in FIG. 4, the sheet of stock 12 is folded with a plurality of transverse folds 22, 24, and 26 that are all mutually parallel to each other and parallel to the transverse upper and lower edges 14 and 16. The sheet 12 is also initially die cut with a pair of incisions 28 and 30. Each of the incisions 28 and 30 has a central portion that is laterally centered and extends parallel to the lower sheet edge 16, which is located proximate thereto. The end portions of the incisions 28 and 30 extend diagonally from the opposite ends of the central portion of the incision toward the lower edge 16. However, the ends of these incisions terminate short of the lower edge 16, ending at least about one-half of an inch therefrom.

To construct the document folder 10 the sheet 12 is first folded in one direction along the transverse fold line 22, and then folded in the opposite direction along the transverse fold lines 24 and 26. Folding the sheet 12 in this manner defines a front pocket 32 and a rear pocket 34. The folds 22, 24, and 26 form the rear pocket 34 with a back panel 36 and an apron panel 38. Similarly, the front pocket 32 is also formed with an apron panel 40 and a back panel which is formed by the same panel 38 that serves as the apron panel for the rear pocket 34. A return panel 42 lies between the front pocket apron panel 40 and the panel 38 common to both the front pocket 32 and the rear pocket 34.

The several folds 22, 24, and 26 that create the front pocket 32 and rear pocket 34 delineate bottoms for each of the pockets. Specifically, the fold 26 forms the bottom of the rear pocket 34, while the fold 22 forms the bottom of the front pocket 32. The fold 24 defines the top of the front pocket 32 and lies at the demarcation between the front pocket apron panel 40 and the return panel 42. As best illustrated in FIG. 3, the bottoms of the pockets 32 and 34 are located at different longitudinal distances from the transverse edges 14 and 16 and are spaced from each other a distance of at least about one-half of one inch in a direction perpendicular to the transverse folds 22, 24, and 26.

Once the sheet 12 has been folded transversely at the folds 22, 24, and 26, it is folded longitudinally with a bifurcating, longitudinal fold 46 that extends parallel to the side edges 18 and 20. The longitudinal fold 46 is perpendicular to the transverse folds 22, 24, and 26, as in evident in FIG. 4. The longitudinal fold 46 longitudinally bifurcates the folded structure of the single sheet of stock 12 to form the document holder 10 as a folder with two sets of pockets located side by side, and with two pockets in each set. As illustrated in FIGS. 1 and 2, the folder 10 includes not only the front and rear pockets 32 and 34, respectively, on the right-hand side of the folded sheet 12, but also a corresponding set of pockets 32' and 34' on the left-hand side of the folder 10.

Figure 3:
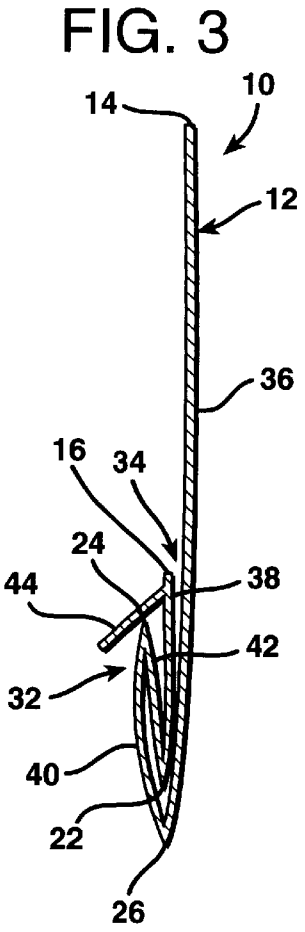
FIG. 3 is a sectional view taken along the lines 3—3 for FIG. 2

Also as illustrated in FIG. 3, the incisions 28 and 30, which lie in the apron panels 38 and 38' for the rear pockets 34 and 34' when the sheet 12 is folded, form a pair of front pocket closure tabs or flaps 44. The front pocket closure flaps 44 are resiliently deflectable from the remaining structure of the rear pocket apron panels 38 and 38', and may be pulled outward to partially overlie and capture the apron panels 40 and 40' of the front pockets 32 and 32', as illustrated in FIGS. 1 through 3. Thus, the single sheet of stock 12 that is utilized to form a plurality of pockets 32, 34, 32', and 34', also forms front pocket closure tabs 44.

Once the structure has been completely folded as illustrated in FIG. 1, the sides of the pockets are sealed along linear bands of sealing 48, 50 and 52. These linear sealing bands are oriented parallel to the side edges 18 and 20 and perpendicular to the top and bottom edges 14 and 16 of the sheet 12.

The bands of sealing 48, 50, and 52 may be created in several ways. For example, layers of adhesive may be applied between the contacting surfaces of the different, adjacent panels forming the folder 10 adjacent the side edges 18 and 20 proximate the rear pocket bottoms formed by the fold 26, and also along a band 50 that straddles the lower portion of the longitudinal fold 46 in the lower region of the folder 10.

Adhesive is not the only form of sealing that may be employed, however. For example, the overlying panels may be stapled together with several staples located within the sealing bands 48, 50, and 52. When the sheet 12 is formed of plastic, the overlying panels may be sealed together at the sealing bands 48, 50, and 52 by sonic welding, thermal fusion, or any other conventional sealing means.

A folder 10 created as depicted and described in FIGS. 1–4 will have a useful life considerably longer than that of conventional, multiple-pocket folders in which pockets are located closely adjacent to each other, as long as the separation between the pocket bottom folds 22 and 26 is at least a predetermined, minimum distance governed by the strength of the sheet of material 12. This distance is preferably at least about one-half of one inch for most conventional folder or document holder materials.

FIGS. 5 through 8 illustrate an alternative embodiment of a document holder 60 constructed according to the present invention. The holder 60 is formed from a single, flat, rectangular sheet of paper, card stock, or plastic stock 62. The sheet 62 is longer and narrower than the sheet 12, since only single set of a plurality of pockets are to be formed from it. The sheet 62 has opposing side edges 76 and 78 that are mutually parallel to each other and perpendicular to the transverse bottom and top edges 72 and 74, respectively. The sheet 62 is folded a plurality of times by mutually parallel, transverse folds 64, 66, and 68. Like the sheet 12, the sheet 62 is die cut with an incision 70 that is identical in geometry to each of the die cut incisions 28 and 30, and which is located proximate the lower, transverse edge 72 and opposite the upper, transverse edge 74 of the rectangular sheet 62.

The sheet 62 is folded along fold lines 64, 66, and 68 in the same manner of folding employed with the sheet 12. Once the sheet 62 has been folded transversely, the folds 64 and 68 respectively delineate the bottom of a front pocket 80 and the bottom of a rear pocket 82. The pocket bottoms formed by the folds 64 and 68 are spaced from each other longitudinally in a direction perpendicular to the transverse folds 64, 66, and 68 a distance of at least about one-half of an inch.

Figure 6:
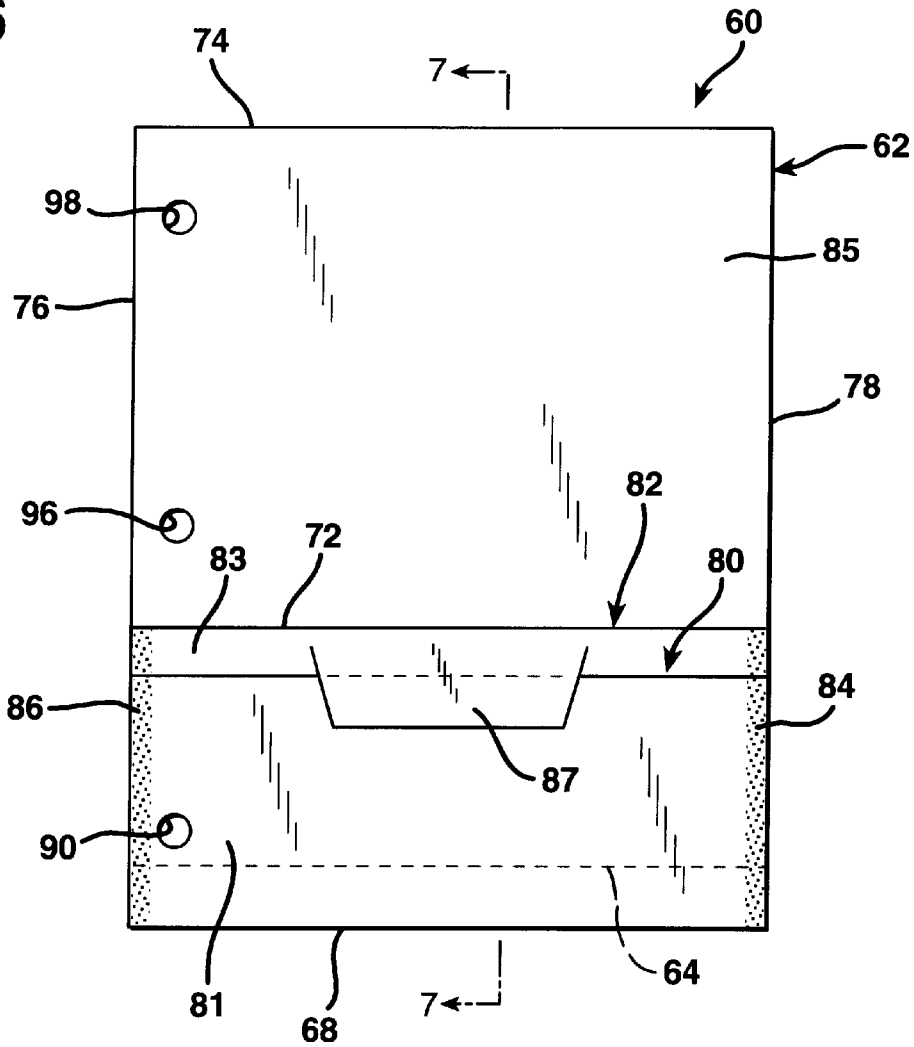
FIG. 6 is a front plan view of the finished document holder of FIG. 5.

As illustrated in FIG. 6, the pockets 80 and 82 have opposing sides, formed by the lower portions of the side edges 76 and 78 of the sheet 62. These opposing pocket sides terminate at the pocket bottoms 64 and 68 and are all closed by bands of sealing 84 and 86, according to any one of the conventional sealing techniques previously described.

As in the embodiments of FIGS. 1–4, the front pocket 80 of the document holder 60 has an apron panel 81 and a back panel 83. The back panel 83 is the same panel that serves as the apron panel for the rear pocket 82. A lengthy rear panel 85 that extends between the top edge 74 and the fold 68 that forms the rear pocket bottom serves as the back panel for the rear pocket 82. The incision 70 creates a front pocket closure flap 87 of the type previously described.

The back panel 85 of the rear pocket 82 extends between the upper transverse edge 74 of the sheet 62 and the bottom of the rear pocket 82 formed by the fold 68. The panel 83 that serves as both the back panel of the front pocket 80 and as the apron panel of the rear pocket 82 extends between the other transverse edge 72 of the sheet 62 and the bottom of the front pocket 84 that is formed by the fold 64. As in the embodiment of FIGS. 1–4, a return panel 89 lies between the front pocket apron panel 81 and the panel 83 that serves as both the apron panel of the rear pocket 82 and the back panel of the front pocket 80.

One further step that is employed in the manufacture of the document holder 60 is that its side margin adjacent the side edge 76 is hole punched with a plurality of fastener apertures 88, 90, 92, 94, 96, and 98. In the finished structure of the document holder 60 at least some of these apertures are spaced longitudinally from each other in a direction extending perpendicular to the transverse folds 64, 66, and 68. Specifically, although the apertures 88, 90, 92, and 94 overlie each other, they are spaced longitudinally from the other apertures 96 and 98 which are also located in the fastening margin.

Figure 8:
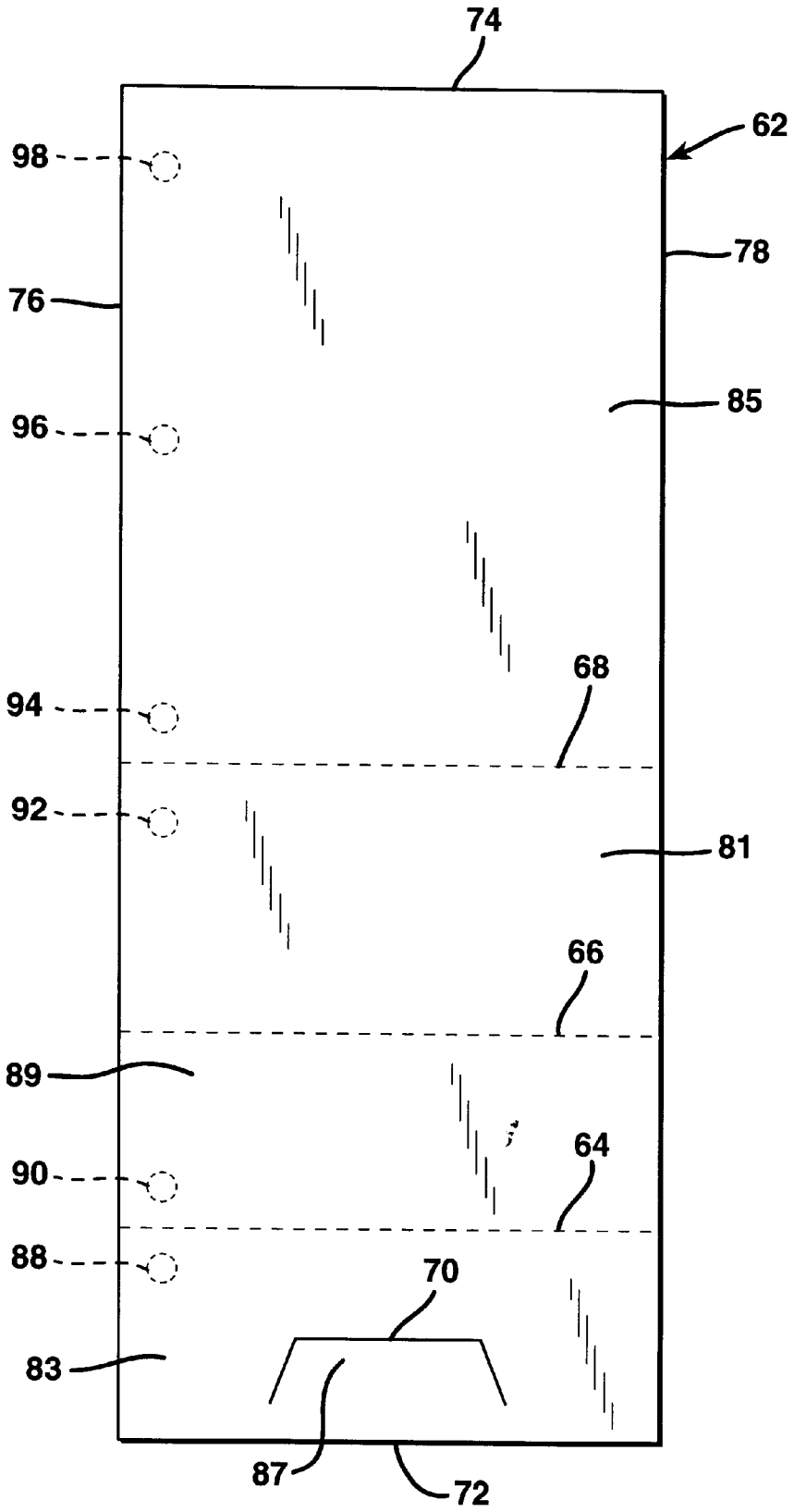
FIG. 8 is a top plan view of the single sheet of stock used to form the document holder of FIGS. 5 and 6.

The aperture locations 88, 90, 92, 94, 96, and 98 are indicated in phantom in FIG. 8, since they are typically not formed prior to folding the sheet 62 along the transverse folds 64, 66, and 68. While the fastener apertures 88, 90, 92, 94, 96, and 98 could be formed in a die punching operation prior to folding the sheet 62, the difficulty in creating a congruent alignment between holes 88, 90, 92, and 94 is such that it is simply easier to punch the holder 60 after folding the edges of the pockets 80 and 82, rather than prior to the folding operation.

FIGS. 9–12 illustrate another embodiment of a document holder according to the present invention that is formed as a folder 100. The folder 100 is formed from a single, expansive sheet 102 of flat paper, card stock, or plastic. The sheet 102 is folded a plurality of times along mutually parallel, transverse folds 104, 106, and 108 to form a plurality of overlying layers 110, 112, 114, and 116 that together delineate a front pocket 118 and a rear pocket 120. Each of these pockets has a bottom. Specifically, the bottom of the front pocket 118 is formed by the fold 104, while the bottom of the rear pocket 120 is formed by the fold 108. The fold 106 delineates the top of the front pocket 118, which is captured by a front pocket closure flap or tab created by the incision 122 in the sheet 102.

Figure 9:
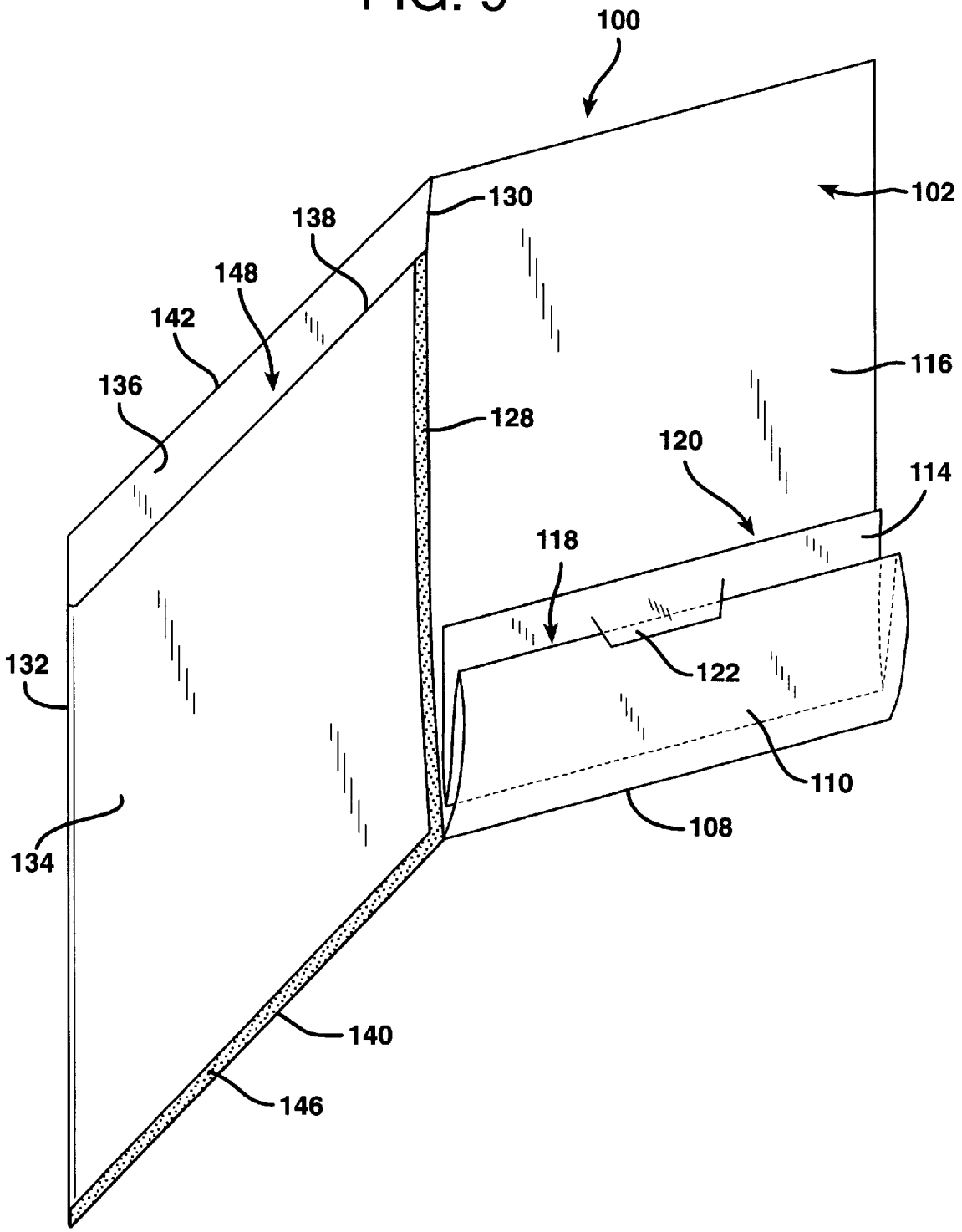
FIG. 9 is a perspective view of a further alternative embodiment of a document holder constructed as a folder according to the invention shown prior to sealing the pockets on one side.
Figure 11:
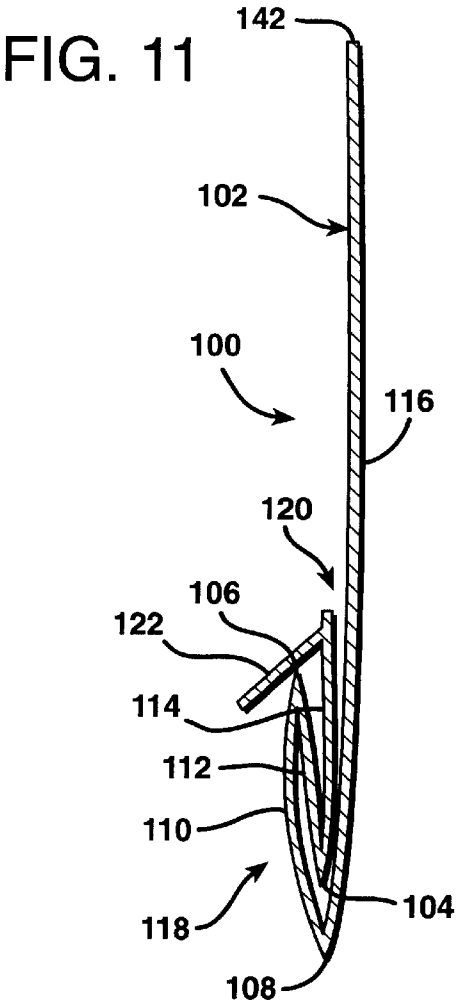
FIG. 11 is a sectional view taken along the lines 11—11 of FIG. 10.
Figure 10:
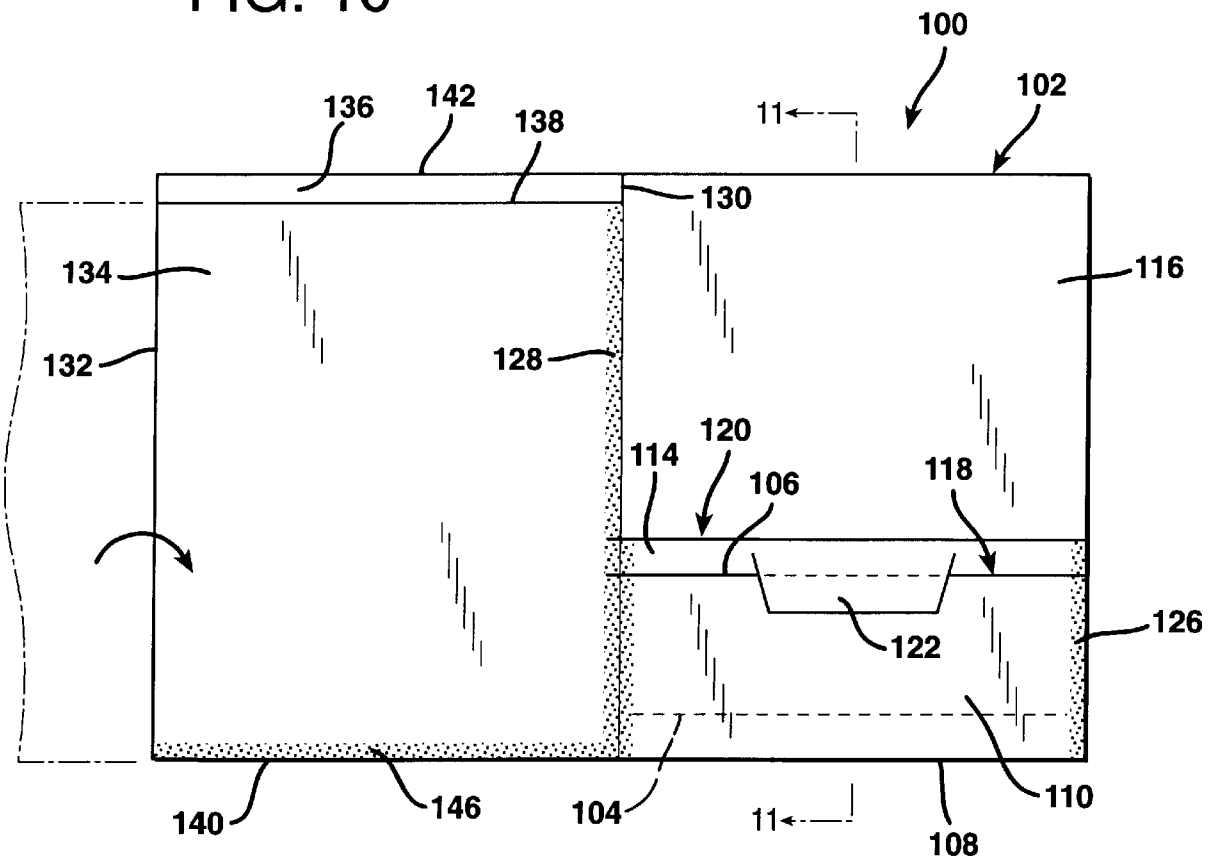
FIG. 10 is a top plan of the finished document holder of FIG. 9.
Figure 12:
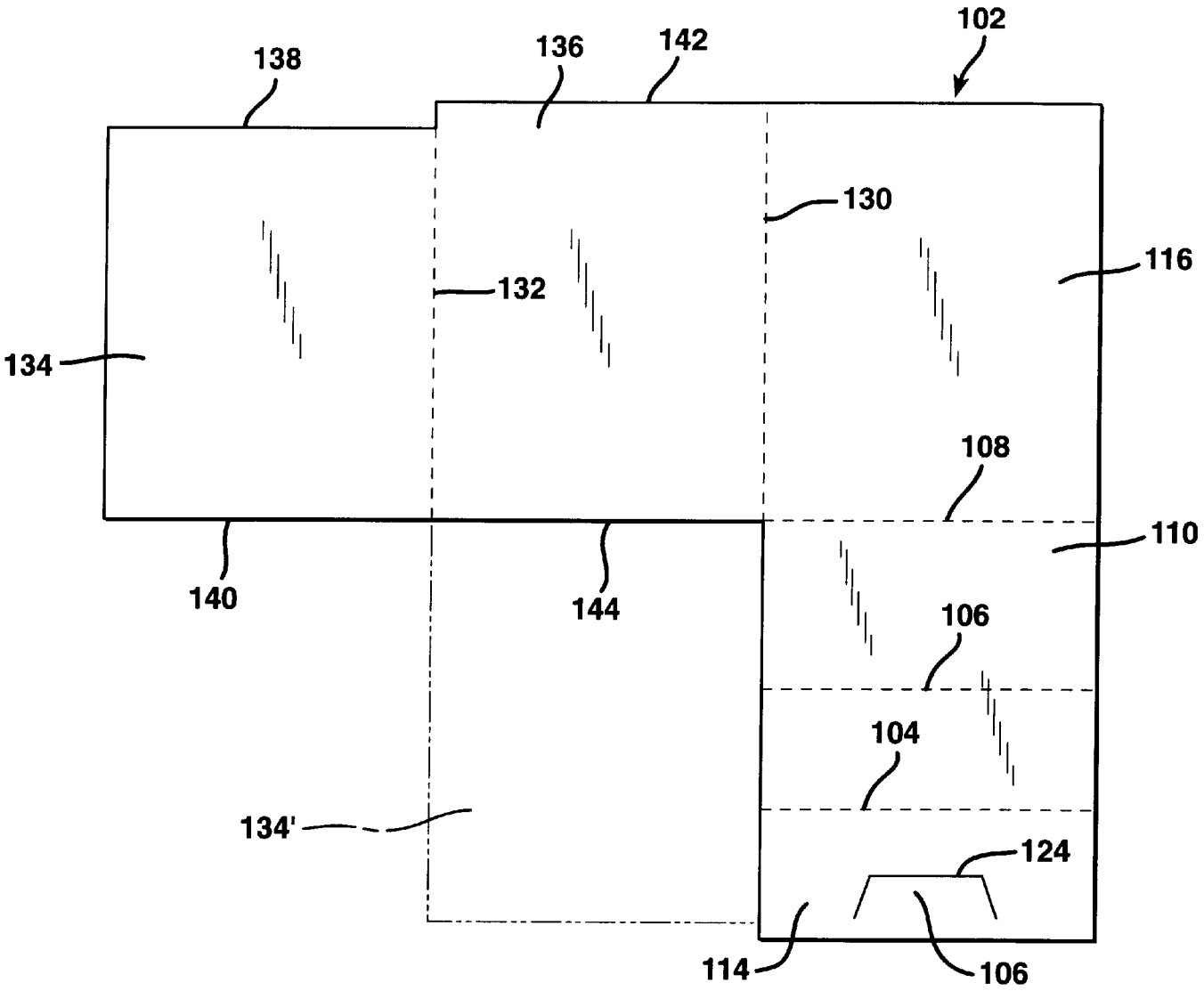
FIG. 12 is a top plan view illustrating the single sheet of material employed in the fabrication of the document holder of FIGS. 9 and 10.

The pockets 118 and 120 are very similar in construction to the pockets 32 and 34 formed in the folder 10 of FIGS. 1–4 and also have side edges that are closed by longitudinal bands of sealing 126 and 128. The right-hand portion of the folder 100, as viewed in FIGS. 9 and 10, is therefore very similar to the right-hand portion of the folder 10.

The left-hand portion of the folder 100 differs considerably from the left-hand portion of the folder 10, however. Specifically, unlike the sheet 12, the sheet 102 is not rectangular in shape. Rather, it is of a generally L-shaped configuration prior to folding. Also, once the sheet 102 is folded transversely along the transverse folds 104, 106, and 108, it is also divided longitudinally, first by a longitudinal folder delineation fold 130 that extends perpendicular to the transverse folds 104, 106, and 108, and also by a second longitudinal fold 132. The fold 132 serves as the delineation between a lateral or transversely-extending apron panel 134 and a back panel 136. The apron panel 134 has top and bottom edges 138 and 140, respectively, while the back panel 136 has top and bottom edges 142 and 144, respectively. The distance between the edges 138 and 140 is slightly less than the distance between the edges 140 and 144, but by a small amount, for example about three-quarters of an inch. The apron panel 134 is folded back on top of the back panel 136 and is sealed thereto along the longitudinal band of sealing 128 and a transverse band of sealing 146 that secures the lower edges 140 and 144 of the panels 134 and 136 together.

The transverse folds 104, 106, and 108 delineate the front pocket 118 and the rear pocket 120 on the right-hand side of the longitudinal folder delineation fold 130. The folder 100 is thereby created with a pair of shallower pockets 118 and 120 on one side of the folder delineation fold 130 and a single, larger, deeper pocket 148, formed between the apron panel 134 and the back panel 136, on the other side of the folder delineation fold 130. The larger, deeper pocket 148 is a top-opening pocket that is delineated by the folder delineation fold 130 on one side and by the second, longitudinal fold 132 parallel to the folder delineation fold 130 on its opposite side. The deep pocket apron panel 134 is formed from a lateral extension of the sheet of stock 102 from the second longitudinal fold 132.

It should be understood that different configurations of sheet stock can be employed to produce the various forms of document holders of the invention. For example, the sheet 102 could be modified so as to include a longitudinal extension from the lower edge 144 of the back panel 136 rather than a lateral extension from the fold line 132. In this case an apron panel 134' would be formed, as indicated in phantom in FIG. 12, in place of the apron panel 134. Rather than including a transverse line of sealing 146 with such a construction, the apron panel 134' would be attached by a second longitudinal band of sealing parallel to the sealing band 128 which would replace the fold 132 at the coinciding longitudinal edges of the apron panel 134' and backing panel 136. Various other sheet configurations are also possible to produce different styles and shapes of pockets, still within the scope of the invention.

Figure 13:
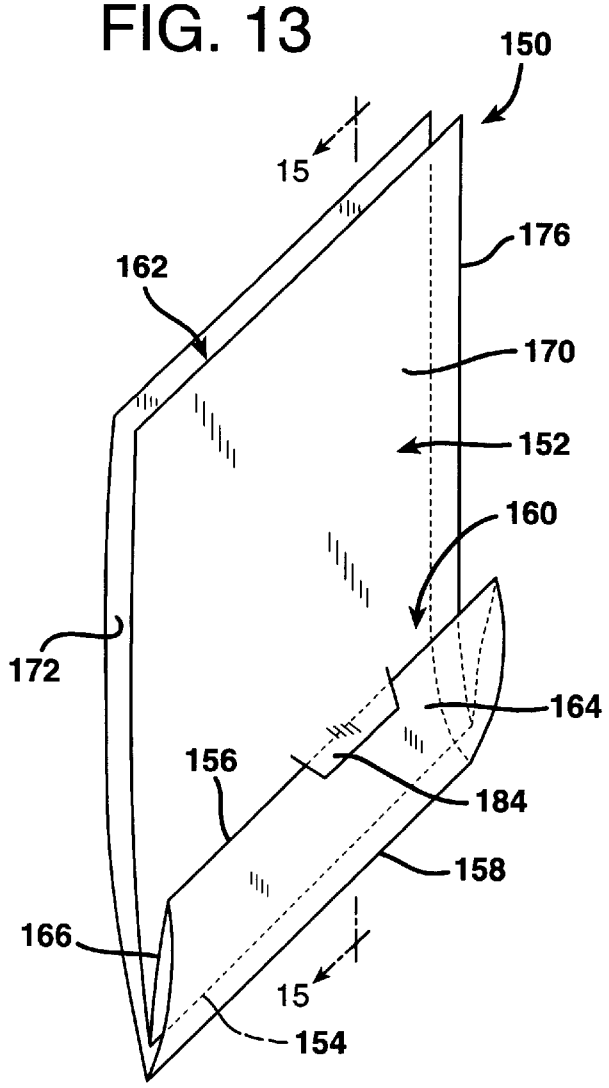
FIG. 13 is a perspective view of another embodiment of a document holder constructed according to the invention shown prior to sealing the sides of the pockets thereof.
Figure 15:
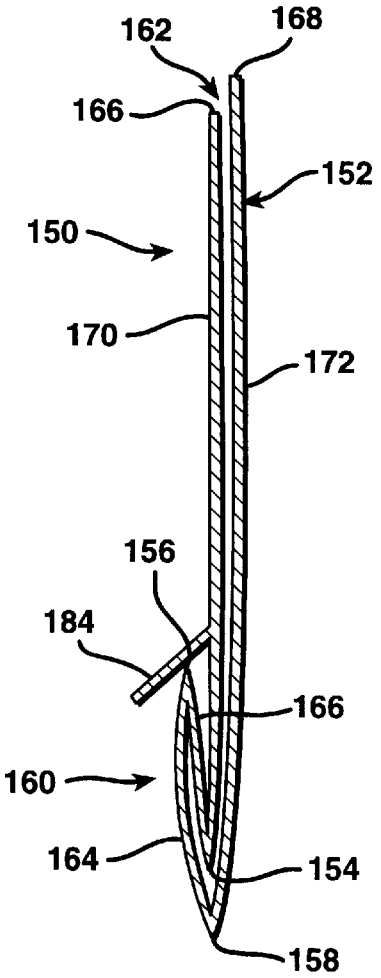
FIG. 15 is a sectional view taken along the lines 15—15 of FIG. 13.
Figure 14:
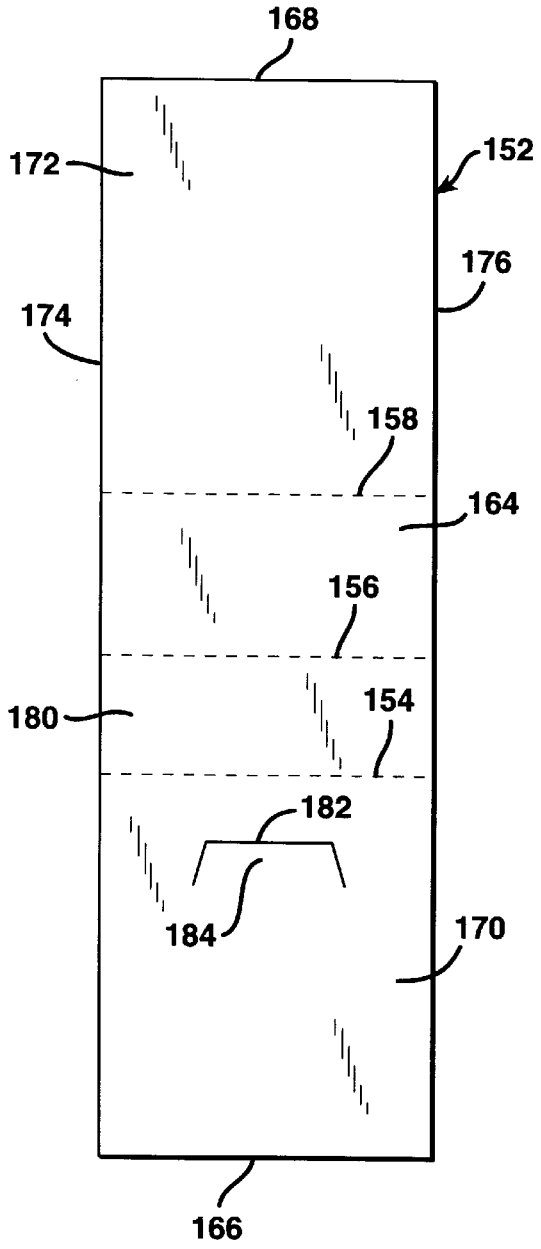
FIG. 14 is a top plan view of the single sheet of material that is folded to form the document holder of FIG. 13.

For example, FIGS. 13–15 illustrate still another document holder 150, constructed according to the invention. The document holder 150 is formed by folding a single, flat, elongated, rectangular sheet of stock 152 along transverse folds 154, 156, and 158 to create a front pocket 160 and a rear pocket 162. It should be noted that the opposing, transverse, bottom and top edges 166 and 168 of the folded sheet 152 reside within one inch of each other, as depicted in FIGS. 13 and 15. As a result, the apron panel 170 covers the back panel 172 of the rear pocket 162 almost completely, although it still only partially overlies the back panel 172. The spaced separation of the transverse edges 166 and 168 allows a small top margin of documents placed in the rear pocket 162 to protrude above the top edge 166 of the rear pocket apron panel 170 so that these papers may be grasped for insertion and removal.

The front pocket 160 of the document holder 150 is not as deep as the rear pocket 162. The opposing sides of both the front pocket 160 and the rear pocket 162 are sealed shut throughout their lengths, so that the sides of the pocket panels that terminate at the opposing longitudinal edges 174 and 176 are sealed shut throughout their mutually coextensive lengths. That is, one of the faces of the front pocket return panel 166 is sealed at both of its laterally opposite sides to the front pocket apron panel 164. The other face of the return panel 166 is sealed throughout its length to the panel 170, which serves as the back panel of the front pocket 160. These panels are sealed together near their lateral extremities throughout their lengths of mutual contact where their sides terminate at the longitudinal side edges 174 and 176 of the sheet 152. Also, the rear pocket back panel 172 is sealed to the panel 170, which serves as a rear pocket apron panel, throughout the length of the panel 170. The rear pocket 162 is thereby sealed throughout the lengths of its sides and is open only at the top.

As in the other embodiments a die cut incision 182 in the panel 170 forms a front panel closure tab 184 that is releasably engaged with the top of the front pocket apron panel 164, as previously described. Also, as in the other embodiments of the invention, the bottoms of the pockets 160 and 162, formed respectively by the folds 154 and 158, are separated from each other by a distance of at least about one-half of one inch.

Figure 16:
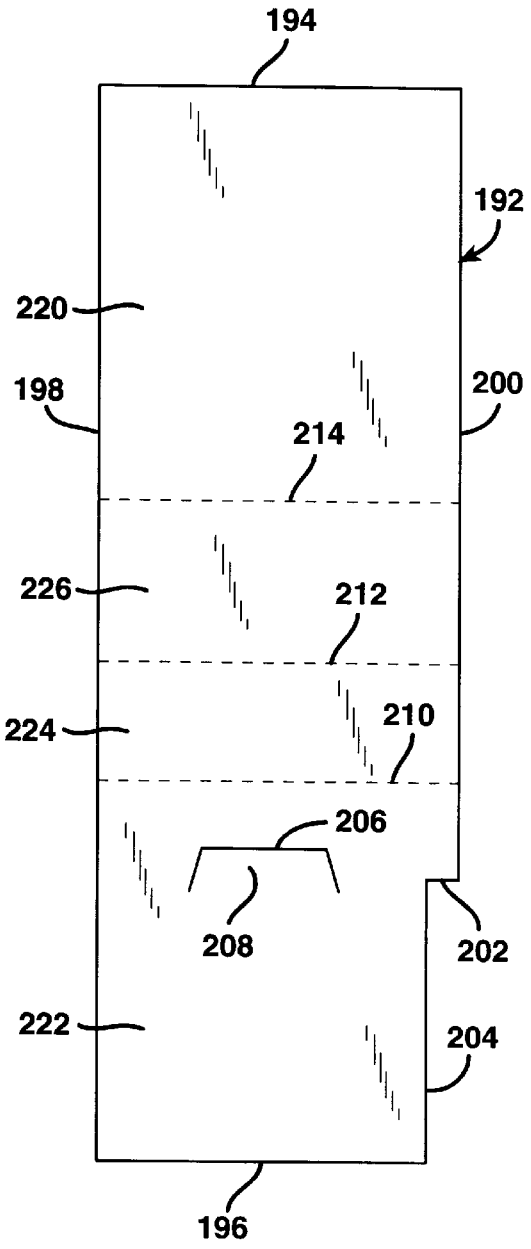
FIG. 16 is a top plan view of the single sheet of flat stock employed to create another embodiment of a document holder according to the invention.
Figure 18:
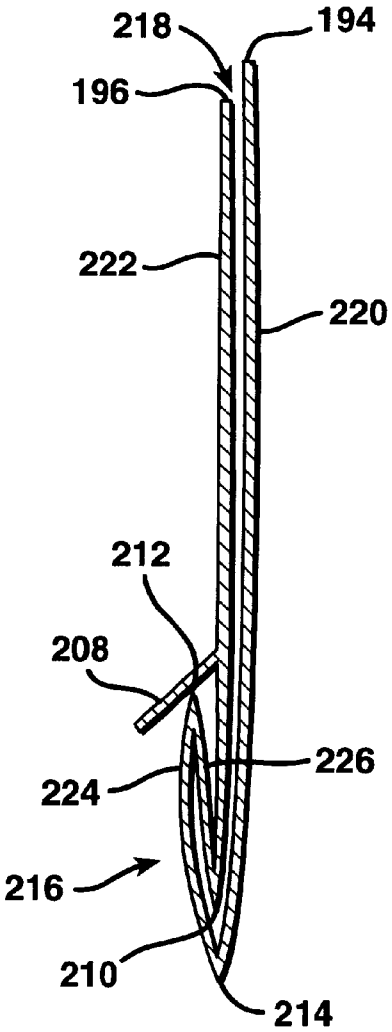
FIG. 18 is a sectional view taken along the lines 18—18 of FIG. 17.
Figure 17:
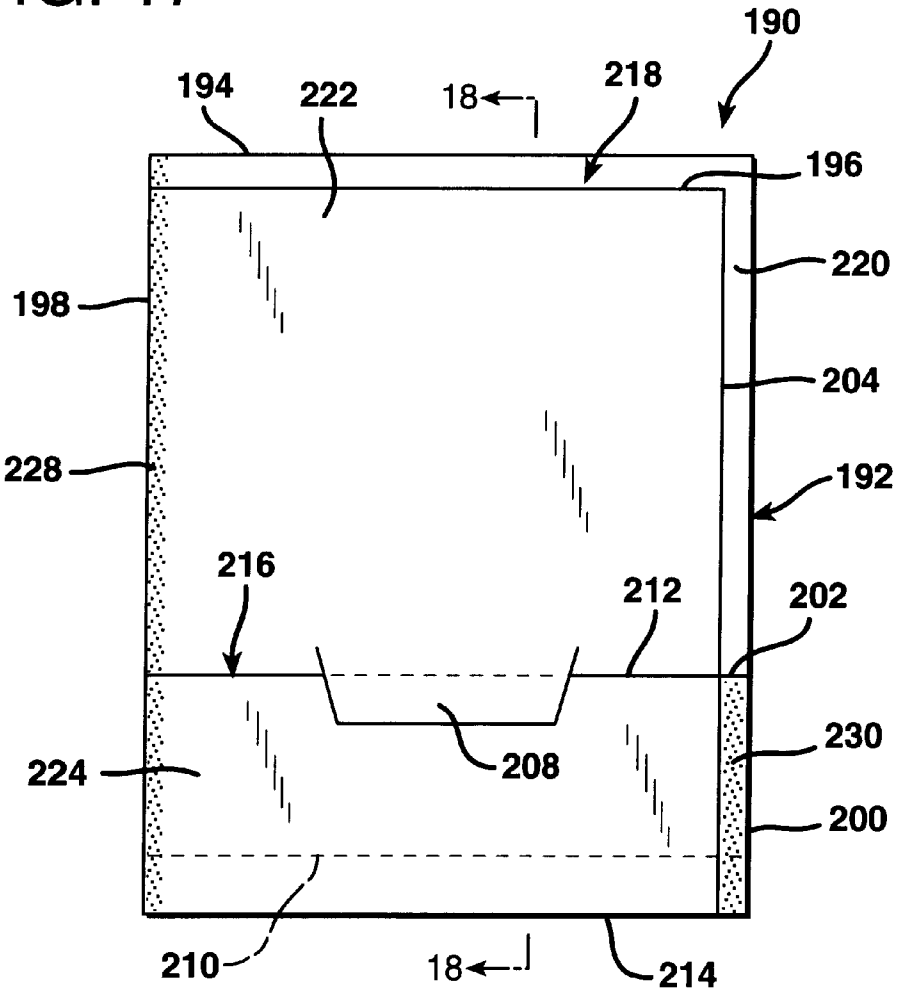
FIG. 17 is a top plan view of a document holder created from the single sheet of flat stock depicted in FIG. 16.

FIGS. 16, 17, and 18 illustrate another, alternative embodiment of a document holder 190 constructed according to the invention. The document holder 190 is formed of a single, folded, flat sheet of stock 192, depicted prior to folding in FIG. 16. As illustrated in that drawing figure, the sheet 192 is not quite rectangular in shape. As in the other embodiments, the sheet 192 has a pair of mutually parallel, transverse end edges 194 and 196. The linear edge 198 is typically about twenty-seven and a half inches in length. One linear side edge 198 extends between and is perpendicular to the transverse end edges 194 and 196. On the other side of the sheet 192 the longitudinal side edge 200 extends perpendicular to the end edge 194, and terminates at a transverse indentation 202 located a distance of about seven and a half inches from the transverse end edge 196. This side of the sheet 192 then continues with a linear side edge 204 from the transverse indentation 202. The liner side edge 204 perpendicularly intersects the end edge 196.

The single sheet of flat stock 192 is formed with an incision 206 that creates a front pocket closure flap 208. The sheet 192 is folded transversely along the transverse fold lines 210, 212, and 214 to create a front pocket 216 and a rear pocket 218. The rear pocket 218 has a back panel 220 and an apron front panel 222. The bottom of the rear pocket 218 is defined by the fold 214 that delineates the back panel 220 of the rear pocket 218 from the apron panel 224 of the front pocket 216. A return panel 226 extends from the fold 212 at the top of the front apron panel 224 to the fold 210 that defines the bottom of the front pocket 216. As in the other embodiments of the invention, the bottoms of the front pocket 216 and rear pocket 218, formed by the folds 210 and 214, respectively, are at least about one-half of an inch apart.

When the sheet 192 is folded to form the document holder 190, the opposing, transverse end edges 194 and 196 reside within one inch of each other. As is evident in FIGS. 17 and 18, the front pocket 214 is therefore not nearly as deep as the rear pocket 218. As in the document holder 150, the apron panel 222 of the rear pocket 218 only partially overlies the back panel 220 of the rear pocket 218. The panel 222 serves as both the apron panel of the rear pocket 218 and as the back panel of the front pocket 216.

As illustrated in FIG. 17, the left sides of the pockets 216 and 218 are sealed together along a linear band of sealing 228 that extends substantially throughout the entire length of the folded structure of the document holder 190. The band of sealing 228 terminates just short of the end edge 194, however, but only for the distance that the back panel 220 protrudes longitudinally beyond the panel 222.

On the opposite side of the document holder 190 a band of sealing 230 extends only over a much shorter distance. Specifically, the band of sealing 230 seals the side edge 200 throughout the entire lengths of both the panels 224 and 226, but only throughout the lower portion of the panel 220 from the fold line 214. The band of sealing 230 extends the distance between the fold 210 and the transverse notch 202. Both of the opposing sides of the front pocket 216 are thereby sealed shut throughout their lengths. As is evident in FIG. 17, the width of the front pocket 216 is the same as that of the rear pocket 218.

The rear pocket 218 is sealed throughout its length only on one side at the band of sealing 228. At its opposite side the rear pocket 218 is closed only in its lower region where it is captured by the band of sealing 230. That portion of the panel 222 that extends longitudinally beyond the front pocket apron panel 224 of the front pocket 216 is left unsealed.

Figure 19:
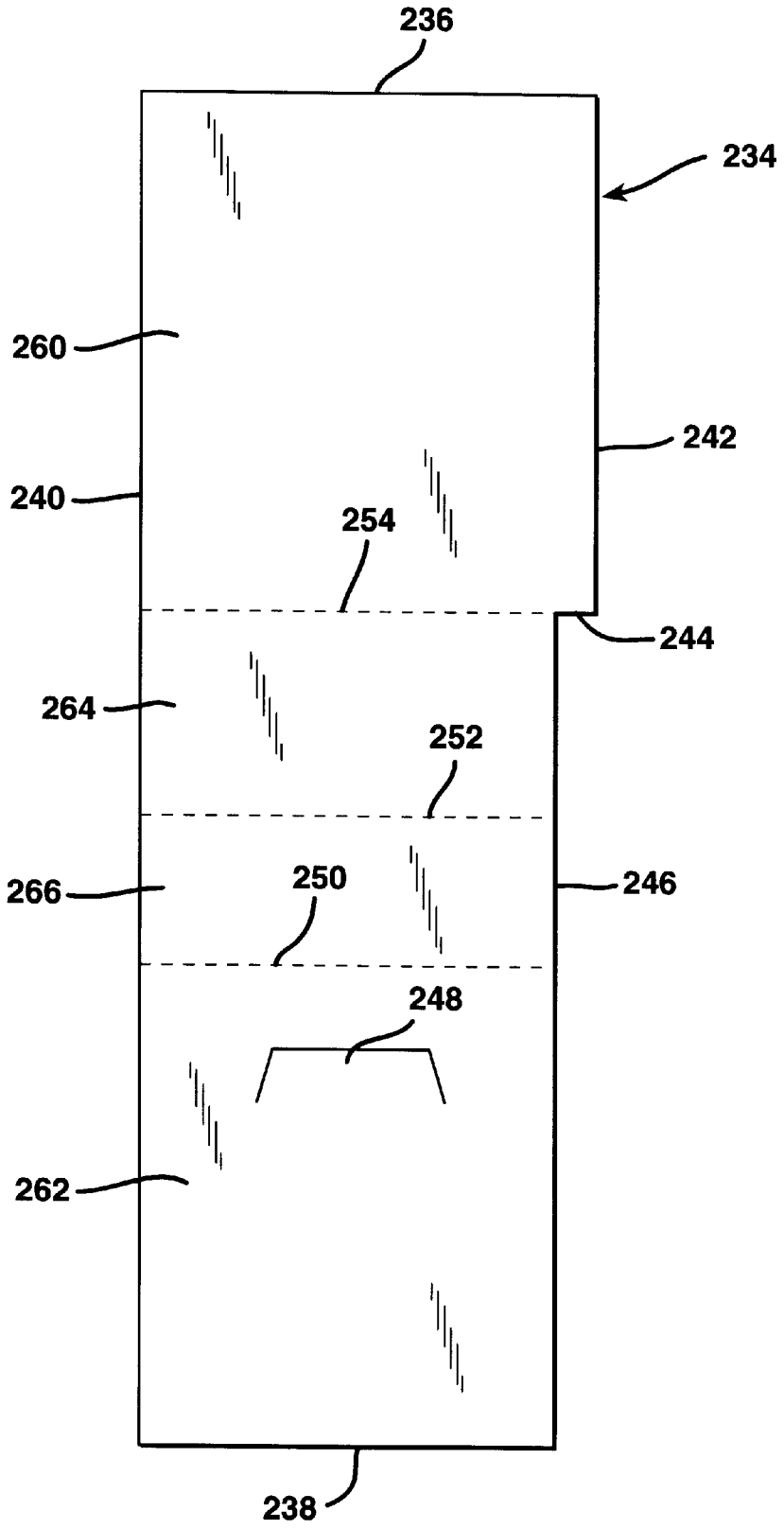
FIG. 19 is a top plan view of the single sheet of flat stock employed to create another embodiment of a document holder according to the invention.
Figure 21:
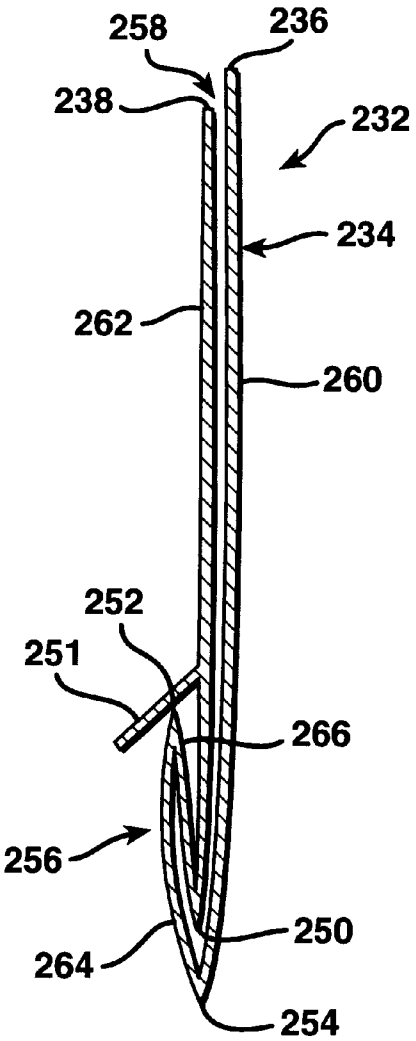
FIG. 21 is a sectional view taken along the lines 21—21 of FIG. 20.
Figure 20:
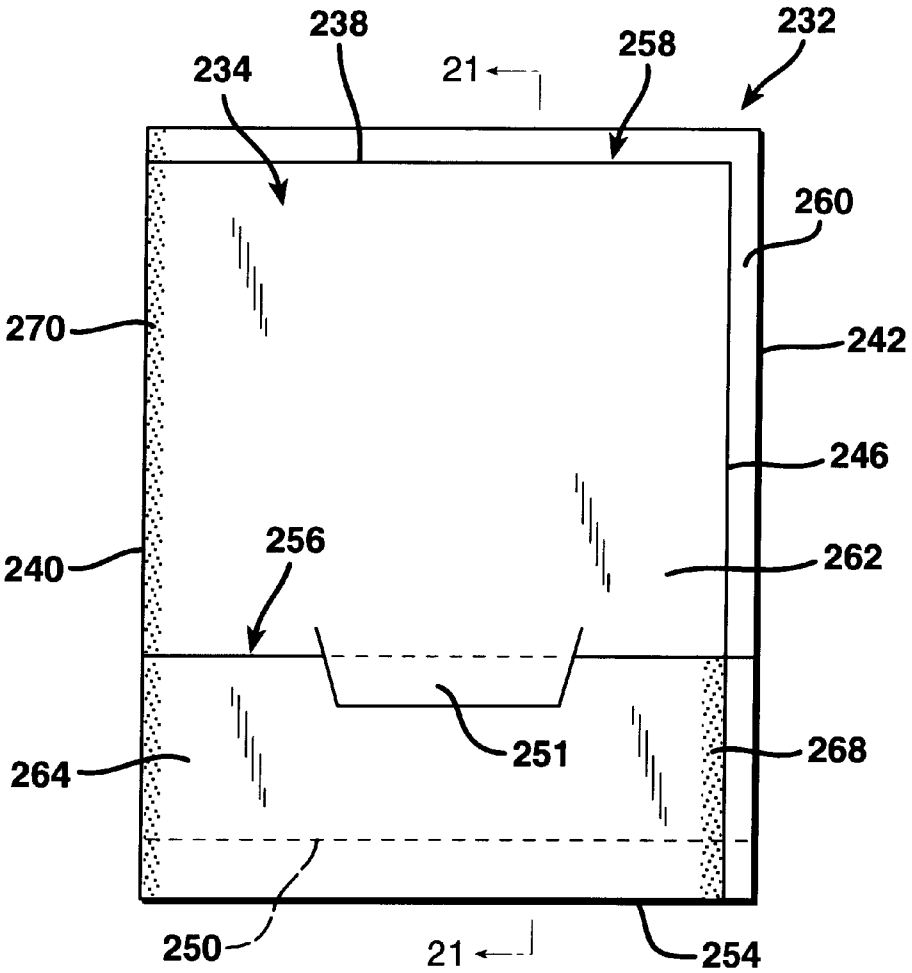
FIG. 20 is a top plan view illustrating a document holder formed from the single sheet of flat stock illustrated in FIG. 19.

FIGS. 19, 20, and 21 illustrate still another document holder 232 constructed according to the present invention. The document holder 232 is also formed of a single sheet of flat stock 234 having transverse end edges 236 and 238. One side of the sheet 234 is formed by an elongated, linear side edge 240 that extends between and is perpendicular to the transverse end edges 236 and 238. The side edge 240 may, for example, be about twenty-seven and a half inches in length. At its opposite side the sheet 234 has a linear side edge 242 that extends perpendicular to the end edge 236 a distance of about twelve inches. The side of the sheet 234 is then notched in with a transverse recess 244, about three-quarters of an inch in length. The remainder of the right-hand side of the sheet 234 is formed by a longitudinal side edge 246 that extends from the inner end of the recess 244 to the end edge 238.

The sheet 234 is formed with a die cut incision 248 that forms a front pocket closure flap 251. The sheet 234 is folded along a plurality of mutually parallel, transverse folds 250, 252, and 254 to form a front pocket 256 and a rear pocket 258. The rear pocket 258 is formed with a back panel 260 and an apron panel 262. The bottom of the rear pocket 258 is formed by the transverse fold 254. The front pocket 256 has an apron panel 264 that extends between the folds 254 and 252. A return panel 266 extends from the top of the front pocket apron panel 264 that is formed by the fold 252 to the bottom of the front pocket, which is formed by the fold 250. The front pocket bottom formed by the fold 250 and the rear pocket bottom formed by the fold 254 are longitudinally spaced from each other a distance of at least one-half of one inch. The panel 262 that extends upwardly from the front pocket bottom 250 functions both as the back panel of the front pocket 256 and as the apron panel of the rear pocket 258.

In the construction of the document holder 232, the sheet 234 is first folded in one direction along the fold line 252, and then folded in the opposite direction at the fold 250. This brings the panels 262 and 264 into contact with the return panel 266 interposed therebetween. These three panels are then sealed together along a band of sealing 268, so as to close the right-hand side of the front pocket 256, as viewed in FIG. 20. The sheet 234 is only then folded at the fold 254 so as to form the rear pocket 258. The sheet 234 is then sealed along a band of sealing 270 adjacent the opposite side edge 240 to close the other side of the front pocket 256, and to close the left-hand side of the rear pocket 258, as viewed in FIG. 20.

With this construction the front pocket 256 is open only at its top, formed by the fold 252, and may be closed by the front pocket closure flap 251. The front pocket 256 is sealed along both of its opposing sides throughout its length by the bands of sealing 268 and 270.

The rear pocket 258, on the other hand, is open not only along its top, formed by the end edge 238, but also along its right-hand side, which is formed by that portion of the side edge 242 of the sheet 234 that extends from the fold 254 along the length of the panel 262. With this construction documents may be inserted into the rear pocket 258 either from the top over the end edge 238 of the rear pocket apron panel 262, or from the side since the rear pocket apron panel 262 and the rear pocket back panel 260 are not sealed to each other adjacent the side edges 242 and 246 thereof, respectively.

Undoubtedly, numerous other variations and modifications of the invention will become readily apparent to those familiar with office supply products. Accordingly, the scope of the invention should not be construed as limited to the specific embodiment depicted and described herein.

I claim:

1. A document holder formed from a single, flat sheet of stock folded a plurality of times by at least three mutually parallel, transverse folds that together form at least two pockets, and one of said two pockets is a rear pocket and the other of said two pockets is a front pocket, and wherein some of said transverse folds delineate bottoms for said pockets, and said pocket bottoms are spaced from each other in a direction perpendicular to said transverse folds, and said rear pocket is deeper than said front pocket and said pockets have opposing sides that terminate at said pocket bottoms and at least one side of each of said pockets is closed, and all of said opposing sides of said front pocket are closed.

2. A holder according to claim 1 wherein said transverse folds delineate a back panel and an apron panel for each of said front and rear pockets, and said apron panel for said rear pocket serves as said back panel for said front pocket.

3. A holder according to claim 2 further comprising a front pocket closure tab cut in said apron panel for said rear pocket, and said front pocket closure tab is resiliently deflectable to extend out over and overhang and capture said apron panel of said front pocket.

4. A holder according to claim 1 which is longitudinally bifurcated by a longitudinal fold extending perpendicular to said transverse folds, thereby forming a folder with two sets of at least two pockets as aforesaid, one set residing on each side of said longitudinal fold.

5. A holder according to claim 1 which is divided longitudinally by a longitudinal folder delineation fold extending perpendicular to said transverse folds, and said transverse folds delineate said at least two pockets on one side of said longitudinal folder delineation fold, and further comprising a larger, deeper pocket on the other side of said longitudinal fold.

6. A holder according to claim 5 wherein said larger, deeper pocket is formed with a back panel having opposite sides delineated by said folder delineation fold and by a second longitudinal fold parallel to said folder delineation fold, and a deep pocket apron panel formed from a lateral extension of said sheet of stock from said second longitudinal fold which is folded on top of said back panel and secured thereto.

7. A holder according to claim 1 having a side margin which is hole punched with a plurality of fastener apertures, at least some of which are spaced from each other in a direction extending perpendicular to said transverse folds.

8. A holder according to claim 1 wherein the width of said front pocket is the same as that of said rear pocket.

9. A holder according to claim 1 wherein one of said opposing sides of said rear pocket is sealed shut only adjacent said bottom thereof.

10. A holder according to claim 1 wherein said bottoms of said pockets are spaced from each other a distance of at least about one-half of one inch.

11. A document holder formed from a single sheet of flat stock having a pair of opposing, mutually parallel, transverse edges and a pair of opposing, mutually parallel, longitudinal edges, wherein said sheet of flat stock is folded with a plurality of transverse folds parallel to said transverse edges to define a plurality of pockets, including a front pocket and a rear pocket, each formed with a back panel and an apron panel, and each having a bottom, and said bottoms of said pockets are located at different longitudinal distances from said transverse edges in spaced separation from each other, and said apron panel of said rear pocket serves as said back panel of said front pocket, and said pockets have sides which are sealed shut along lines of sealing parallel to said longitudinal edges.

12. A document holder according to claim 11 wherein said back panel of said rear pocket extends between one of said opposing transverse edges of said sheet and said bottom of said rear pocket, and said apron panel of said rear pocket extends between the other of said opposing transverse edges of said sheet and said bottom of said front pocket.

13. A document holder according to claim 12 wherein said apron panel of said rear pocket only partially overlies said back panel of said rear pocket.

14. A document holder according to claim 13 wherein said other of said opposing transverse edges resides within one inch of said one of said opposing transverse edges.

15. A document holder according to claim 11 wherein said apron panel of said rear pocket is cut with an incision to form a front pocket closure flap which is resiliently deflectable from the remaining structure of said rear pocket apron panel to partially overlie and capture said apron panel of said front pocket.

16. A document holder according to claim 11 wherein said bottoms of said pockets reside in spaced separation from each other a distance of at least about one-half of an inch.

* * * * *